US007849800B2

(12) United States Patent
Hinsdale et al.

(10) Patent No.: US 7,849,800 B2
(45) Date of Patent: Dec. 14, 2010

(54) HYBRID SPIN/FIN STABILIZED PROJECTILE

(75) Inventors: Andrew J. Hinsdale, Oro Valley, AZ (US); Richard Dryer, Oro Valley, AZ (US)

(73) Assignee: Raytheon Company, Waltham, MA (US)

( * ) Notice: Subject to any disclaimer, the term of this patent is extended or adjusted under 35 U.S.C. 154(b) by 647 days.

(21) Appl. No.: 11/821,759

(22) Filed: Jun. 24, 2007

(65) Prior Publication Data

US 2010/0213307 A1 Aug. 26, 2010

(51) Int. Cl.
*F42B 10/00* (2006.01)

(52) U.S. Cl. ..... 102/501; 102/473; 102/490; 244/3.23; 244/3.24

(58) Field of Classification Search ..... 102/501, 102/490, 473; 244/3.23, 3.24
See application file for complete search history.

(56) References Cited

U.S. PATENT DOCUMENTS 4,546,940 A 10/1985 Andersson et al.
5,386,951 A * 2/1995 Gaywood ..... 244/3.22
6,135,387 A * 10/2000 Seidel et al. ..... 244/3.15
2005/0051667 A1 3/2005 Arlton et al.

FOREIGN PATENT DOCUMENTS

WO WO-2009/002449 A1 12/2008

OTHER PUBLICATIONS

"International Application Serial No. PCT/US2008/007710, International Search Report and Written Opinion mailed Oct. 2, 2008", 9 pgs.

* cited by examiner

*Primary Examiner*—J. Woodrow Eldred
(74) *Attorney, Agent, or Firm*—Schwegman, Lundberg & Woessner, P.A.; Gregory J. Gorrie

(57) ABSTRACT

A hybrid spin/fin stabilized projectile. The novel projectile includes a body, a first mechanism for spin stabilizing the body during a first mode, and a second mechanism for fin stabilizing the body during a second mode. In an illustrative embodiment, the projectile includes a rifling band adapted to engage with rifling in a gun during gun launch to impart a spin rate compatible with spin stabilization to the projectile, and a plurality of folding fins attached to an aft end of the body. A fin locking mechanism locks the fins in an undeployed position during the first mode and unlocks to deploy the fins at a predetermined time to switch the projectile to fin stabilization during the second mode. The projectile also includes a mechanism for reducing the spin of the projectile to a rate compatible with guided flight during the second mode.

30 Claims, 6 Drawing Sheets

HYBRID SPIN/FIN STABILIZED PROJECTILE

BACKGROUND OF THE INVENTION

1. Field of the Invention

The present invention relates to projectiles. More specifically, the present invention relates to systems and methods for stabilizing guided projectiles.

2. Description of the Related Art

Conventional projectiles are typically spin stabilized. With spin stabilization, the projectile rotates at a high spin rate around its longitudinal axis. This keeps the orientation of the projectile under control.

Guided projectiles use a guidance system for navigating the projectile during at least part of its flight path. The guidance system usually requires the projectile to spin at a lower rate than is compatible with spin stabilization. For example, a typical artillery shell needs a spin rate of about 200-300 revolutions per second or more to achieve spin stabilization. In contrast, a typical projectile guidance system operates at spin rates of less than 10-12 revolutions per second.

In order to achieve stability at the lower spin rates, guided projectiles typically employ fin stabilization by adding tail fins on the aft end of the projectile. Unfortunately, the tail fins which provide the required stability also provide high aerodynamic drag. This aerodynamic drag reduces the maximum range of the projectile (as compared with a spin stabilized projectile).

Hence, a need exists in the art for an improved system or method for stabilizing guided projectiles that offers increased range over prior approaches.

SUMMARY OF THE INVENTION

The need in the art is addressed by the hybrid spin/fin stabilized projectile of the present invention. The novel projectile includes a body, a first mechanism for spin stabilizing the body during a first mode, and a second mechanism for fin stabilizing the body during a second mode. In an illustrative embodiment, the projectile includes a rifling band adapted to engage with rifling in a gun during gun launch to impart a spin rate compatible with spin stabilization to the projectile, and a plurality of folding fins attached to an aft end of the body. A fin locking mechanism locks the fins in an undeployed position during the initial spin stabilized mode and unlocks to deploy the fins at a predetermined time, such as when a specific environment or flight condition is satisfied, to switch the projectile to fin stabilization during the second mode. The projectile also includes a mechanism for reducing the spin of the projectile to a rate compatible with guided flight during the fin stabilized mode. In a preferred embodiment, the projectile includes a novel fin locking mechanism responsive to centrifugal force and a rocket motor designed to provide a counter-torque to reduce the spin rate of the projectile.

DESCRIPTION OF THE INVENTION

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

The present invention provides a simple, low cost approach to extending the ballistic range of a guided projectile. It combines the low drag performance of a spin stabilized projectile during initial flight with that of a fin stabilized projectile during guided flight. Therefore, the projectile obtains additional range during that portion of flight in which it is spin stabilized.

The guidance system of a guided projectile typically does not begin to control the navigation of the projectile until it is at or beyond apogee (the highest point of the flight trajectory). The initial half of the trajectory can therefore be in an unguided projectile configuration using spin stabilization without detrimentally affecting the performance of the guidance system. The projectile can then be switched to a fin stabilization configuration just prior to when the guidance system takes over control of projectile navigation. This approach combines the benefits of initial spin stabilization for longer range and fin stabilization for controllability.

Figure 1:
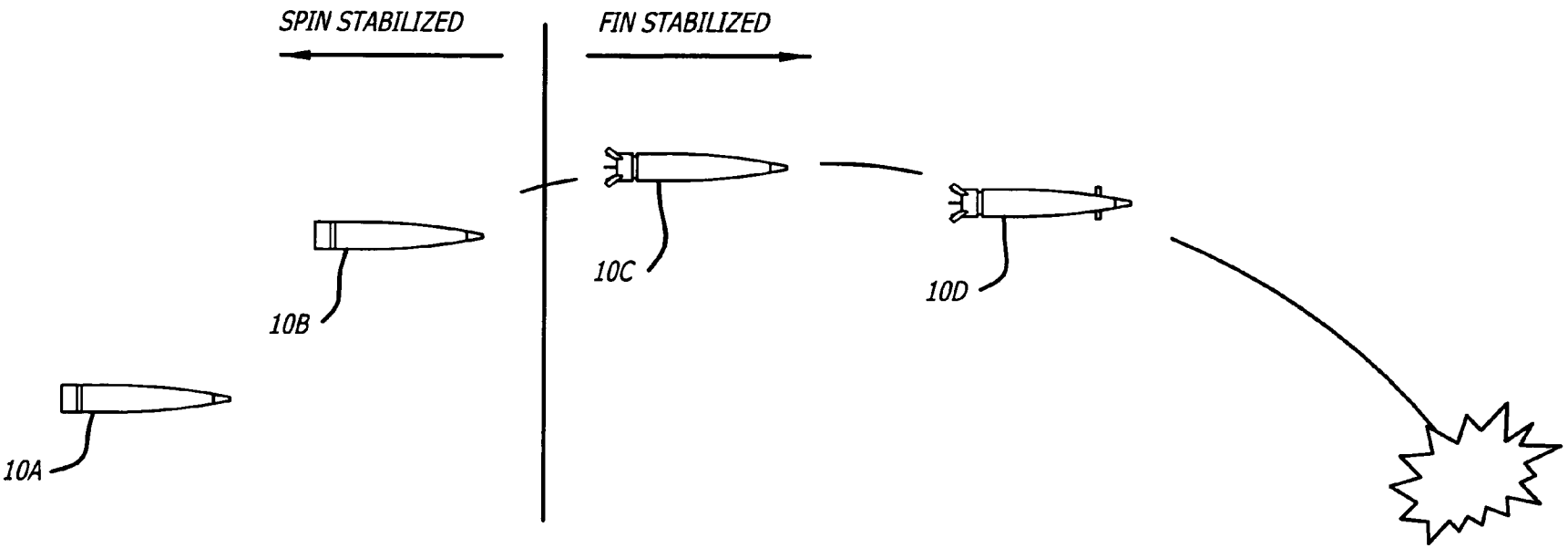
FIG. 1 is a diagram showing a guided projectile designed in accordance with the present teachings at different points along an illustrative flight path.

FIG. 1 is a diagram showing a guided projectile designed in accordance with the present teachings at different points along an illustrative flight path. During the initial portion of the projectile's flight, the projectile 10A is spin stabilized, rotating at a high spin rate imparted to the projectile during firing by the rifling in the barrel of the gun. At a predetermined time, the spin rate of the projectile 10B is reduced. In an illustrative embodiment, the spin rate is reduced using a rocket motor with a swirl nozzle or other mechanism for providing a counter-torque. The projectile 10B begins to de-spin when the rocket motor is ignited. When the spin rate is reduced to an appropriate point, tail fins on the projectile 10C are deployed, switching the projectile 10C to fin stabilization. Finally, when the spin rate is low enough such that the guidance system can operate properly, the guidance system takes over control of the projectile 10D, guiding it to its target.

Figure 2A:
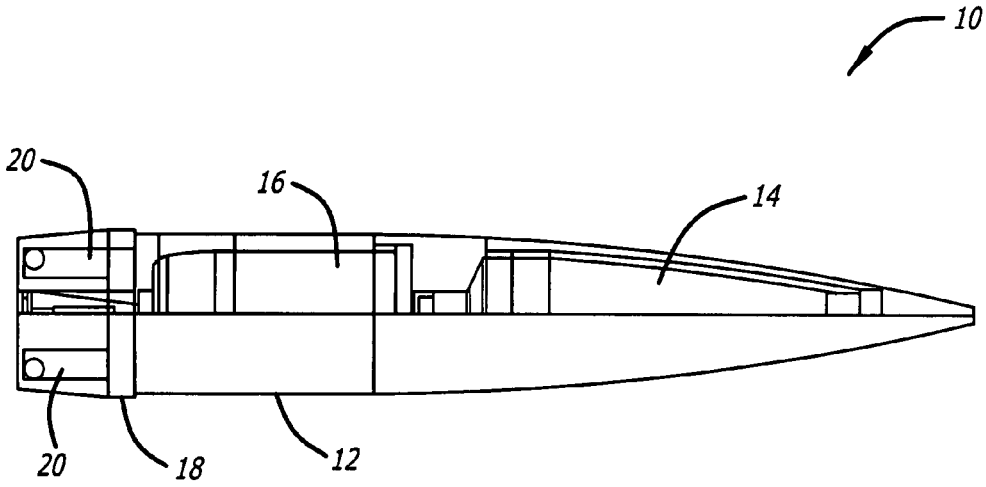
FIG. 2*a* is a simplified schematic of a guided projectile designed in accordance with an illustrative embodiment of the present teachings, showing the projectile in a spin stabilized mode.
Figure 2B:
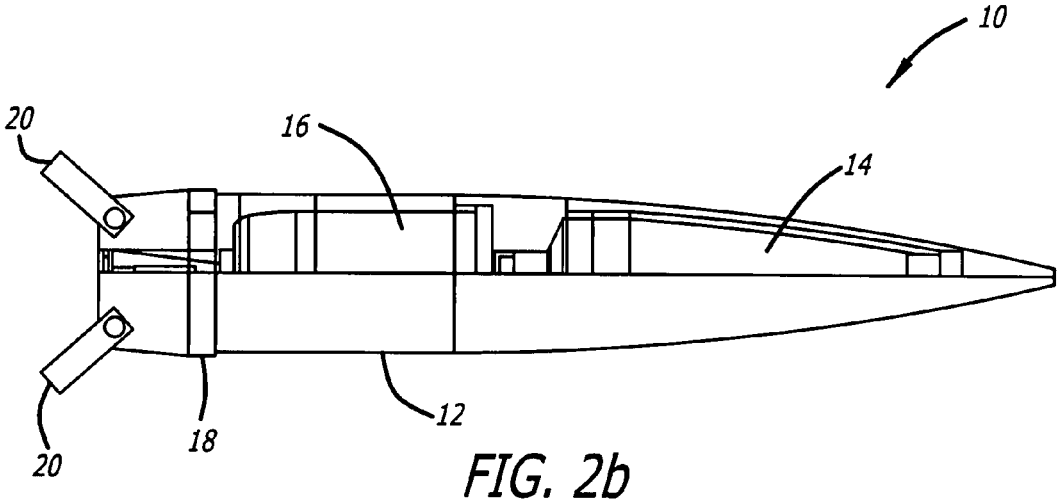
FIG. 2*b* is a simplified schematic of a guided projectile designed in accordance with an illustrative embodiment of the present teachings, showing the projectile in a fin stabilized mode.

FIGS. 2*a* and 2*b* are simplified schematics of a guided projectile 10 designed in accordance with an illustrative embodiment of the present teachings. FIG. 2*a* shows the projectile 10 during a spin stabilized mode and FIG. 2*b* shows the projectile 10 in a fin stabilized mode. The guided projectile 10 includes a body 12, which houses a guidance system 14 and may also house a rocket motor 16. The rocket motor 16 extends the range of the projectile 10 by boosting the projectile to a higher velocity or sustaining the projectile velocity, counteracting aerodynamic drag.

In accordance with the present teachings, the projectile 10 also includes a rifling band or rotating band 18, which engages with the rifling in the barrel of a gun when fired to impart a spin to the body 12 so that the projectile 10 is spin stabilized during the initial portion of its flight. In an illustrative example, the projectile 10 has a spin rate of about 250-300 Hz during the spin stabilized mode. The spin rate is then reduced to about 2-20 Hz during the fin stabilized mode.

The projectile 10 also includes a plurality of folding tail fins 20 attached to the aft end of the projectile body 12. During the initial portion of the projectile's flight, the projectile 10 is spin stabilized and the tail fins 20 are stowed in an undeployed position, close to the body 12 (as shown in FIG. 2*a*). Deployment of the fins 20 is delayed until the projectile's spin rate is reduced such that the fins 20 can be deployed without structural damage. After the tail fins 20 are in the deployed position (as shown in FIG. 2*b*), the projectile 10 is fin stabilized.

The projectile 10 also includes some mechanism for switching from the initial spin stabilized mode to the final fin stabilized mode. This process involves reducing the spin rate of the projectile 10 to a rate compatible with the guidance system 14, and deploying the tail fins 20. Various methods can be used to reduce the spin rate of the projectile 10 and to control the delayed deployment of the tail fins 20. A few illustrative examples will now be described.

Figure 3:
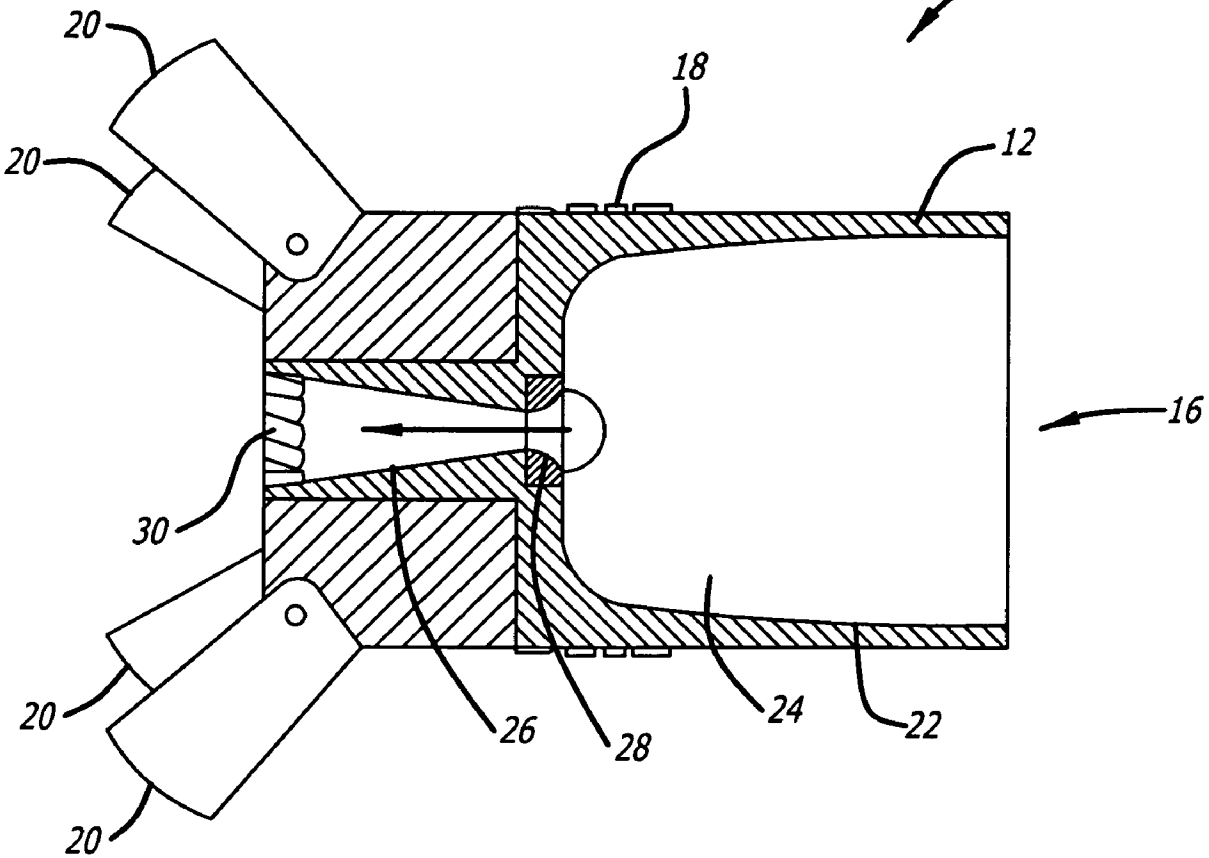
FIG. 3 is a simplified schematic of the aft end of a projectile designed in accordance with an illustrative embodiment of the present teachings that uses the rocket motor to de-spin the projectile.

FIG. 3 is a simplified schematic of the aft end of a projectile 10 designed in accordance with an illustrative embodiment of the present teachings that uses the rocket motor 16 to de-spin the projectile 10. In this embodiment, the rocket motor nozzle or nozzles provide a counter-torque to reduce the spin rate of the projectile 10. The rocket motor 16 includes a combustion chamber 22 filled with a propellant 24 and a nozzle 26. After the propellant 24 is ignited (by an igniter, not shown), the exhaust gas produced escapes through a hole (nozzle insert) 28 in the combustion chamber 22 into the nozzle 26, producing thrust.

In the illustrative embodiment of FIG. 3, the rocket motor nozzle 26 is a swirl nozzle, which includes turning vanes 30 adapted to impart a normal velocity component to the rocket motor thrust to counter-torque the projectile 10 against spin, slowing it down in its rotational axis. The spin rate of the projectile 10 is therefore reduced as the rocket motor 16 burns. An alternative design is to use two or more nozzles that are canted or angled to produce a counter-torque. Other implementations can also be used without departing from the scope of the present teachings.

Rocket motor parameters can be tailored to achieve the desired system characteristics. In the embodiment of FIG. 3, the projectile 10 begins to de-spin when the rocket motor 16 is ignited. The rate at which the spin is reduced, and therefore the time when the spin rate will be low enough for the guidance system to function properly, can be controlled by the rocket motor thrust level, burn time, and swirl nozzle design.

Figure 4:
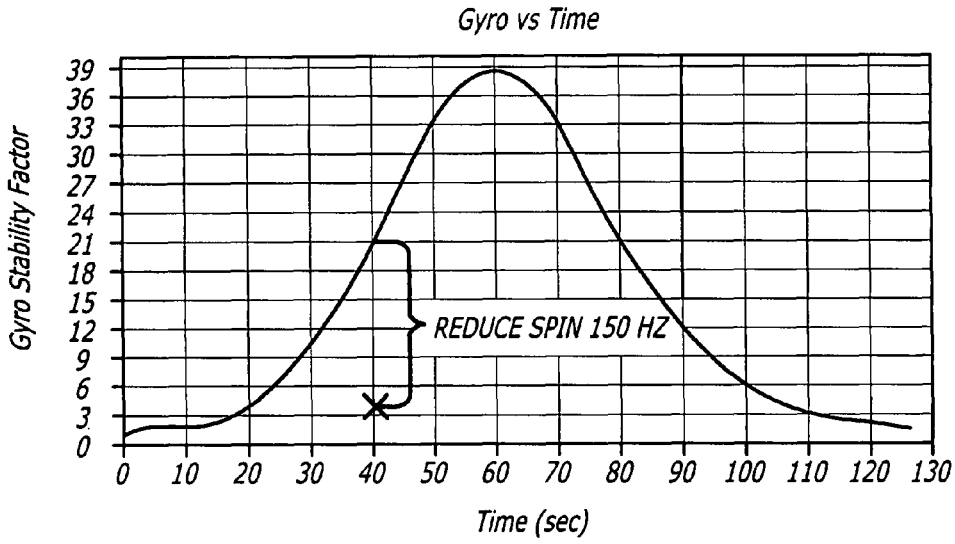
FIG. 4 is a graph of gyroscopic stability factor vs. time of an illustrative spin stabilized projectile, showing an example of when the spin rate can be reduced in accordance with the present teachings.

FIG. 4 is a graph of gyroscopic stability factor vs. time of an illustrative spin stabilized projectile, showing an example of when the spin rate can be reduced in accordance with the present teachings. The gyroscopic stability factor varies during the flight of the projectile, due primarily to changes in air density. The gyroscopic stability factor $S_G$ is given by the following equation:

$$S_G = \left(\frac{I_X^2}{I_Y}\right)\left(\frac{\omega}{V}\right)\left(\frac{2}{\rho\pi d^3 C_{M\alpha}}\right)$$

where $I_X$ is the roll moment of inertia, $I_Y$ is the pitch moment of inertia, ω is the spin rate, V is the velocity, ρ is the air density, d is the diameter, and $C_{M\alpha}$ is the pitching moment coefficient of the projectile.

As shown in FIG. 4, projectile stability increases from about 1 at muzzle exit (time=0 s) to about 39 at apogee (time=60 s). The gyroscopic stability factor $S_G$ only needs to be greater than 1 to provide for stable flight. At some point, the spin rate can therefore be reduced, degrading the stability factor, and still allow for stable flight. For example, as shown in FIG. 4, the spin rate can be reduced from 250 Hz to 100 Hz at a time of 40 s, and still maintain stability ($S_G$ is reduced from about 21 to about 3).

Once the spin rate is reduced enough to avoid structural damage to the tail fins, the fins of the projectile can be deployed, switching the projectile to a fin stabilized mode.

Alternatively, for a projectile without a rocket motor, the spin rate can be reduced by deploying the tail fins and allowing the fins themselves to decelerate the spin of the projectile. This induces a high bending moment load on the fins, so the fins should be much more rugged in this design such that they can absorb the torsional load.

In the illustrative embodiment, the tail fins are locked in the undeployed position during the spin stabilized mode and then unlocked during deployment so they fold out to the fin stabilized position. Various locking mechanisms can be used to control when the fins are deployed. FIGS. 5-6 show two different illustrative embodiments.

Figure 5A:
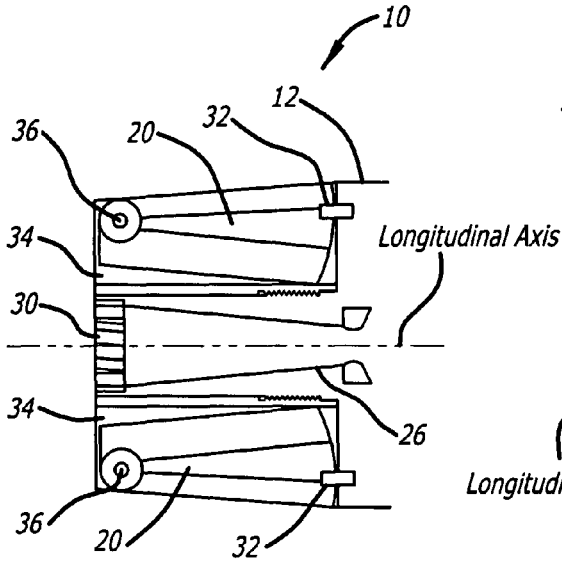
FIG. 5*a* is a simplified schematic of the aft end of a projectile designed in accordance with an illustrative embodiment of the present teachings, showing the tail fins and fin locks in a spin stabilized mode.
Figure 5B:
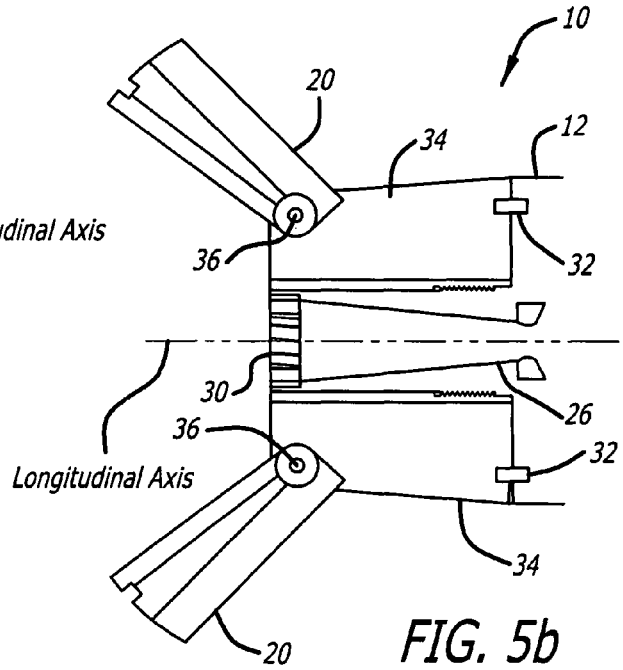
FIG. 5*b* is a simplified schematic of the aft end of a projectile designed in accordance with an illustrative embodiment of the present teachings, showing the tail fins and fin locks in a fin stabilized mode.

FIGS. 5*a* and 5*b* are simplified schematics of the aft end of a projectile 10 designed in accordance with an illustrative embodiment of the present teachings, showing the tail fins 20 and fin locks 32. FIG. 5*a* shows the projectile during the spin stabilized mode and FIG. 5*b* shows the projectile in the fin stabilized mode. When the fin lock 32 is engaged (shown in FIG. 5*a*), the lock 32 keeps the fins 20 in the stowed position, close to the body 12 in a recessed section 34, during the spin stabilized mode. When the lock 32 is retracted (shown in FIG. 5*b*), the fins 20 each rotate about a pivot pin 36 placed in a corner of the fin 20 until they reach their deployed position.

The lock may be an electrical lock that is controlled by an electronic signal supplied by the guidance system. Alternatively, the lock may be controlled by the rocket motor. For example, it could be a pressure lock adapted to unlock when the pressure in the rocket motor is reduced to a certain point (when the amount of propellant remaining in the motor reaches a predetermined level, which, in the embodiment of FIG. 3, corresponds to a particular spin rate of the projectile).

Figure 6A:
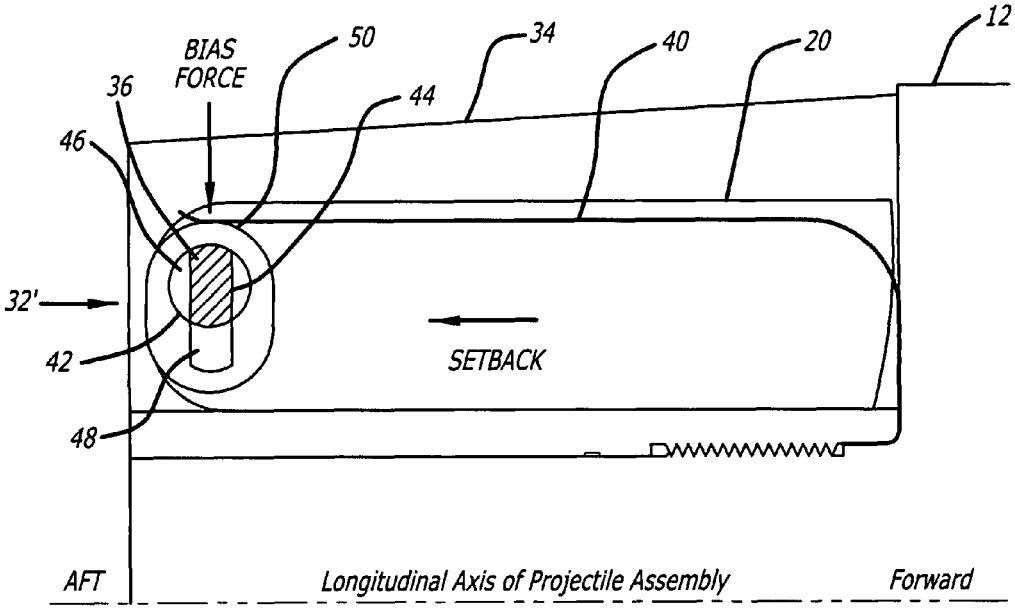
FIG. 6*a* is a simplified schematic of a tail fin with a centrifugal fin lock designed in accordance with an illustrative embodiment of the present teachings, showing the lock during gun launch.
Figure 6B:
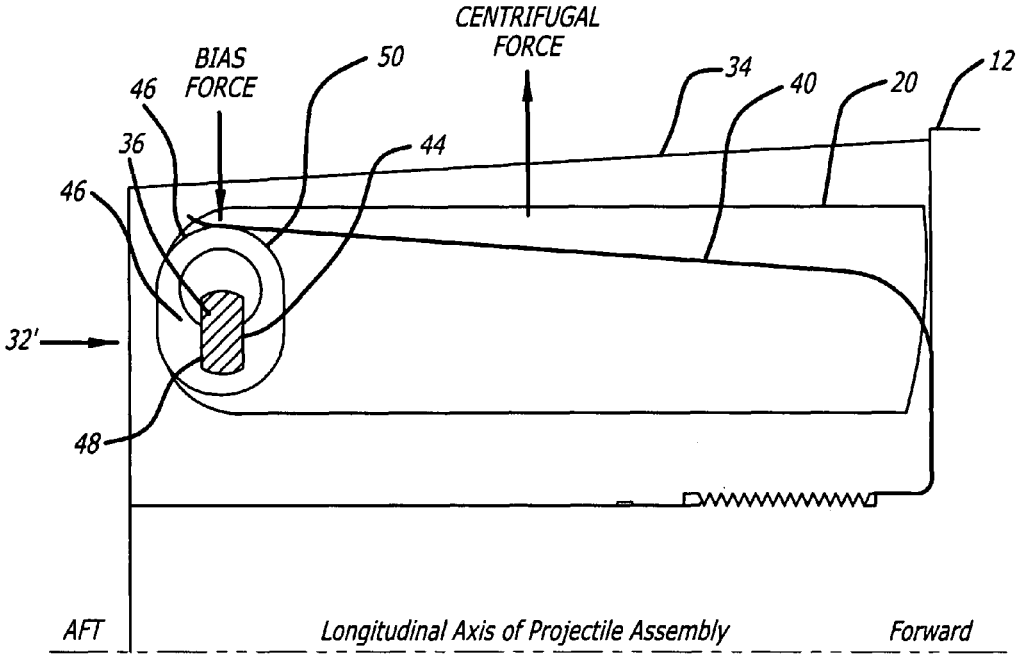
FIG. 6*b* is a simplified schematic of a tail fin with a centrifugal fin lock designed in accordance with an illustrative embodiment of the present teachings, showing the lock after gun launch during high spin.
Figure 6C:
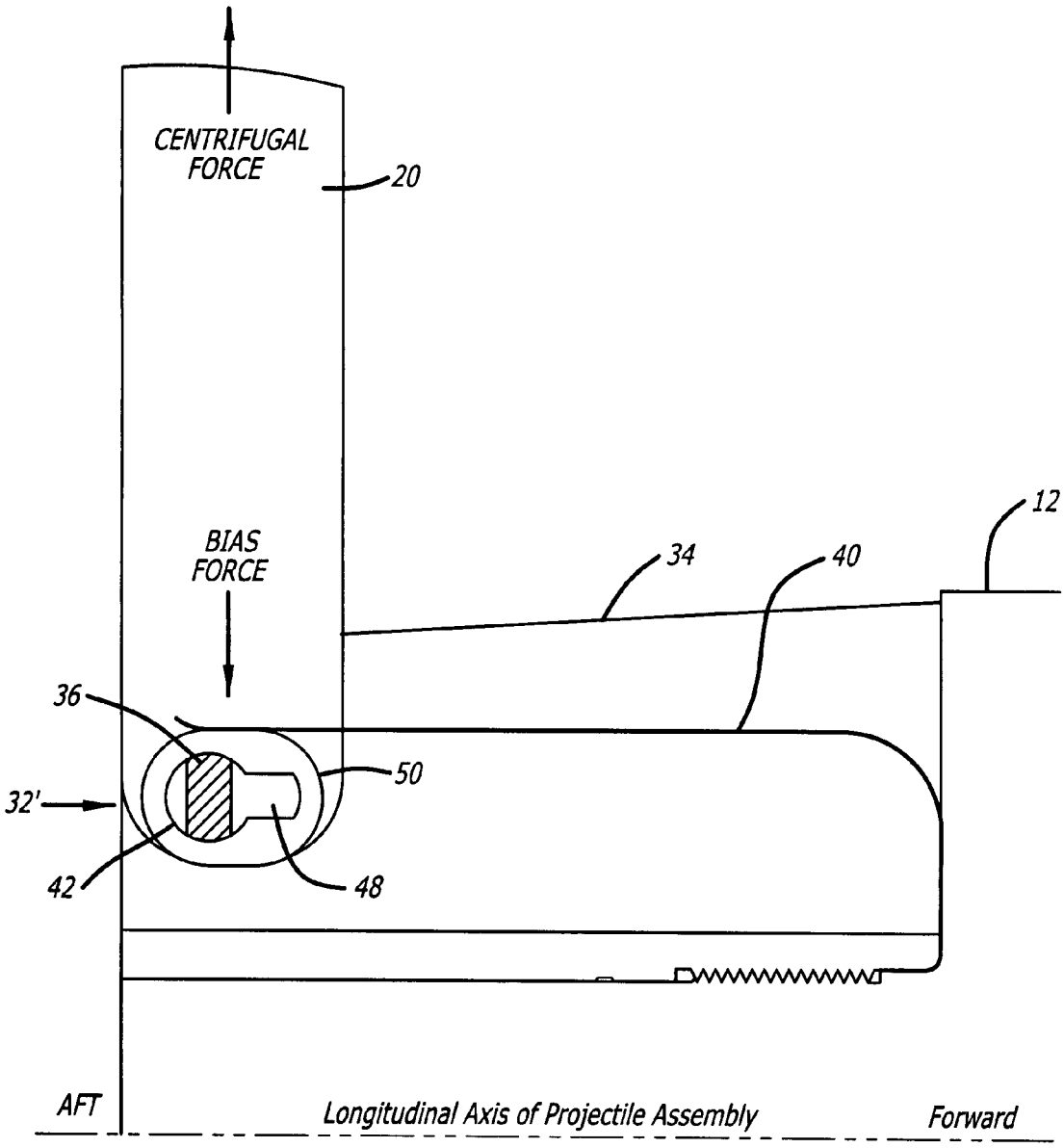
FIG. 6*c* is a simplified schematic of a tail fin with a centrifugal fin lock designed in accordance with an illustrative embodiment of the present teachings, showing the lock during fin deployment.

FIGS. 6*a*-6*c* show a novel centrifugal fin lock 32' that uses centrifugal force to control when the tail fins 20 are deployed. FIG. 6*a* is a schematic of a tail fin 20 with a centrifugal fin lock 32' designed in accordance with an illustrative embodiment of the present teachings, showing the lock 32' during gun launch. FIG. 6*b* shows the lock 32' after launch, during the spin stabilized mode when the projectile has a high spin rate. FIG. 6*c* shows the lock 32' when the fin 20 is deployed. In this embodiment, the fins 20 are deployed when the spin rate of the projectile is reduced to a predetermined point.

The centrifugal lock 32' includes a bias spring 40 and a notch 48 for a pivot pin 36. The tail fin 20 includes a hole 42 in which the pivot pin 36 is inserted. The pivot pin 36, about which the fin 20 rotates, includes two opposing flat sides 44 and 46. The fin 20 also includes a notch 48 next to the pivot hole 42. The notch 48 is shaped so that the pivot pin 36 can fit within, such that the notch 48 engages the flats on the pivot pin 36, preventing the fin 20 from being able to rotate. The bias spring 40 is an L-shaped leaf spring adapted to hold the fin 20 against the projectile body 12 so that the flats on the pin 36 do not engage the notch 48. In the illustrative embodiment, the fin 20 has a round region 50 around the pivot hole 42 and notch 48 which is slightly elevated relative to the plane of the fin 20. The bias spring 40 engages this elevated region 50, applying a bias force that pushes down towards the longitudinal axis of the projectile 10.

As shown in FIG. 6*a*, during gun launch (and during handling, prior to gun fire), the bias spring 40 forces the elevated region 50 of the tail fin 20 down towards the longitudinal axis of the projectile 10. In this position (unlocked position), the pivot pin 36 is in the pivot hole 42, and the notch 48 does not engage the flats on the pin 36. The fin 20 is therefore free to rotate. During gun launch, setback acceleration loads tend to rotate the fin 20 into the stowed position, locking the fin 20 against the projectile body 12 (because the center of gravity of the fin 20 is below the pivot point).

As shown in FIG. 6*b*, after gun launch, the projectile 10 is spinning at a high spin rate and centrifugal force overcomes the bias spring 40. Centrifugal force moves the fin 20 radially outward, away from the projectile body 12, into a locked position in which the notch 48 engages the flats on the pivot pin 36, locking the fin 20 against rotation.

As shown in FIG. 6*c*, as the spin rate decays, at some point the bias spring force overcomes the centrifugal force, moving the fin 20 back into the unlocked position, allowing the fin 20 to rotate. The residual centrifugal force rotates the fin 20 about the pivot pin 36 outwards away from the projectile body 12, into its deployed position.

The bias spring 40 is designed to provide a bias force that overcomes the centrifugal force when the projectile 10 is at a desired spin rate (e.g., when the spin rate is reduced enough to avoid structural damage to the tail fins 20).

Thus, the novel approach of the present invention uses spin stabilization to stabilize a guided projectile during an initial phase (after gun launch) and then switches to fin stabilization sometime during flight, before the guidance system takes over navigation. In a preferred embodiment, a rocket motor designed to provide a counter-torque is used to reduce the spin rate from a rate compatible with spin stabilization to a rate compatible with guided flight. When the spin rate decays to a safe level, tail fins are deployed, switching the projectile to fin stabilization. This hybrid approach optimizes the flight characteristics of the projectile during both the guided and unguided portions of its flight, increasing the overall range of the projectile (as compared with conventional fin stabilization).

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

Accordingly,

What is claimed is:

1. A projectile comprising:

a body;

first means for spin stabilizing the body during a first mode;

second means for fin stabilizing the body during a second mode; and means for reducing a spin rate of the projectile during the first mode prior to deployment of fins for the second mode, wherein the second means includes a plurality of folding fins attached to an aft end of the body, wherein the projectile also includes third means for switching from the first mode to the second mode after the spin rate is reduced, and wherein the third means includes means for locking the fins in an undeployed position during the first mode, the means for locking using centrifugal force to lock the fins in the undeployed position.

2. The projectile of claim 1 wherein the third means includes fourth means for deploying the fins to a deployed position at a predetermined time after the spin rate is reduced.

3. The projectile of claim 2 including means for deploying the fins when a predetermined environment or flight condition is satisfied.

4. The projectile of claim 2 wherein the third means includes fifth means for reducing the spin rate of the projectile.

5. The projectile of claim 4 including means for deploying the fins when the projectile is de-spun to a predetermined spin rate.

6. The projectile of claim 4 wherein the fifth means includes a rocket motor adapted to provide a counter-torque to de-spin the projectile as the rocket motor burns.

7. The projectile of claim 6 wherein the rocket motor includes a swirl nozzle.

8. The projectile of claim 6 wherein the rocket motor includes two or more nozzles angled to produce the counter-torque.

9. The projectile of claim 6 wherein the fourth means includes a fin lock adapted to lock the fins in an undeployed position during the first mode and unlock to deploy the fins in response to a pressure in the rocket motor.

10. The projectile of claim 4 wherein the fourth means includes a fin lock response to centrifugal force adapted to lock the fins in an undeployed position during the first mode and unlock to deploy the fins in response to a bias force when the bias force overcomes the centrifugal force.

11. The projectile of claim 4 wherein the projectile also includes a guidance system for controlling navigation of the projectile during the second mode.

12. The projectile of claim 11 including means for reducing the spin rate to a rate compatible with the guidance system.

13. The projectile of claim 12 wherein the fourth means includes a fin lock adapted to lock the fins in an undeployed position during the first mode and unlock to deploy the fins in response to an electrical signal provided by the guidance system.

14. A projectile comprising:

a body;

a rifling band adapted to engage with rifling in a gun to impart a spin rate compatible with spin stabilization to the body during gun fire;

a plurality of folding fins attached to an aft end of the body;

a fin locking mechanism adapted to lock the fins in an undeployed position during an initial spin stabilized mode and unlock to deploy the fins to switch the projectile to a fin stabilized mode; and a mechanism for reducing the spin rate of the projectile during the spin stabilized mode prior to deployment of the fins to enter the fin stabilized mode.

15. A projectile comprising:

a body;

a rifling band adapted to engage with rifling in a gun to impart a spin rate compatible with spin stabilization to the body during gun fire;

a plurality of folding fins attached to an aft end of the body;

a fin locking mechanism adapted to lock the fins in an undeployed position during an initial spin stabilized mode and unlock to deploy the fins to switch the projectile to a fin stabilized mode; and a mechanism for reducing the spin rate of the projectile during the spin stabilized mode prior to deployment of the fins to enter the fin stabilized mode, wherein the fin locking mechanism is adapted to deploy the fins either after a predetermined time or when a predetermined environment or flight condition is satisfied, wherein the fin locking mechanism uses centrifugal force to lock the fins in the undeployed position.

16. The projectile of claim 15 wherein the mechanism for reducing the spin rate comprises a rocket motor adapted to provide a counter-torque to de-spin the projectile as the rocket motor burns.

17. The projectile of claim 16 wherein the fin locking mechanism is responsive to a pressure in the rocket motor.

18. The projectile of claim 15 wherein the fin locking mechanism is responsive to a bias force to unlock the fins when the bias force overcomes a centrifugal force.

19. The projectile of claim 15 wherein the projectile also includes a guidance system for controlling navigation of the projectile during the fin stabilized mode.

20. The projectile of claim 19 wherein the spin rate is reduced to a rate compatible with the guidance system.

21. The projectile of claim 19 wherein the fin locking mechanism is responsive to an electrical signal provided by the guidance system.

22. A system for controlling deployment of a folding fin on a projectile comprising:

first means responsive to centrifugal force for locking the fin against rotation;

second means for applying a bias force on the fin such that the fin moves to an unlocked position in which it is free to rotate when the bias force overcomes the centrifugal force; and wherein the second means includes means for reducing a spin rate of the projectile while the projectile is spin stabilized prior to the fin moving to the unlocked position.

23. The system of claim 22 wherein the system includes a pivot pin placed through a pivot hole in the fin and attached to the projectile such that the fin can rotate about the pivot pin, the pivot pin having two opposing flat sides.

24. The system of claim 23 wherein the first means includes a notch in the fin next to the pivot hole adapted to engage the flat sides on the pivot pin, locking the fin against rotation, when a centrifugal force greater than the bias force is applied to the fin.

25. The system of claim 24 wherein the second means includes a bias spring adapted to apply a bias force on the fin such that pivot pin is within the pivot hole and out of the notch when the bias force is greater than the centrifugal force.

26. The system of claim 25 wherein the bias spring is adapted to provide a bias force that overcomes the centrifugal force when the projectile is at a predetermined spin rate.

27. The system of claim 26 wherein the pivot hole is positioned such that centrifugal force rotates the fin into a deployed position when the centrifugal force is less than the bias force.

28. The system of claim 27 wherein the pivot hole is positioned such that setback acceleration loads on the fin during gun launch rotate the fin into an undeployed position.

29. A lock for a folding fin on a projectile comprising:

a pivot pin placed through a pivot hole in the fin and attached to the projectile such that the fin can rotate about the pivot pin, the pivot pin having two opposing flat sides;

a notch in the fin next to the pivot hole adapted to engage the flat sides on the pivot pin, locking the fin against rotation, when a centrifugal force greater than a bias force is applied to the fin; and a bias spring adapted to apply a bias force on the fin such that the fin is in an unlocked position in which it is free to rotate when the bias force is greater than the centrifugal force, wherein a spin rate of the projectile is reduced while the projectile is spin stabilized prior to the fin moving to the unlocked position.

30. A method for stabilizing a guided projectile including the steps of:

imparting a high spin rate compatible with spin stabilization on the projectile during launch;

reducing the spin rate of the projectile to a spin rate compatible with guided flight;

deploying tail fins after the spin rate is reduced to switch the projectile to fin stabilization; and applying a bias force to overcome a centrifugal force to unlock and deploy the tail fins, the centrifugal force holding the tail fins in a locked position during spin stabilization.

* * * * *